US008439197B2

(12) United States Patent
Yajima et al.

(10) Patent No.: US 8,439,197 B2
(45) Date of Patent: May 14, 2013

(54) DAMPING BODY FOR PACKAGING AND PACKAGE BODY

(75) Inventors: Toshitsugu Yajima, Saitama (JP); Toshiyuki Kamada, Saitama (JP)

(73) Assignee: Shin-Etsu Polymer Co., Ltd., Tokyo (JP)

( * ) Notice: Subject to any disclaimer, the term of this patent is extended or adjusted under 35 U.S.C. 154(b) by 538 days.

(21) Appl. No.: 12/525,831

(22) PCT Filed: Jul. 6, 2007

(86) PCT No.: PCT/JP2007/063575

§ 371 (c)(1),
(2), (4) Date: Sep. 23, 2010

(87) PCT Pub. No.: WO2008/096462

PCT Pub. Date: Aug. 14, 2008

(65) Prior Publication Data

US 2011/0005957 A1 Jan. 13, 2011

(30) Foreign Application Priority Data

Jan. 23, 2006 (JP) ..... P2006-014230
Dec. 15, 2006 (JP) ..... P2006-339015
Feb. 6, 2007 (JP) ..... P2007-027210

(51) Int. Cl.
*B65D 85/48* (2006.01)

(52) U.S. Cl.
USPC ..... 206/454; 206/523; 206/592; 206/710

(58) Field of Classification Search ..... 206/454, 206/523, 591, 592, 710, 722–724, 832; 211/41.18; 118/500
See application file for complete search history.

(56) References Cited

U.S. PATENT DOCUMENTS 5,366,080 A * 11/1994 Carstersen et al. ..... 206/723
6,298,989 B1 * 10/2001 Chu ..... 206/592
6,405,873 B2 * 6/2002 Koike ..... 206/592
7,584,851 B2 * 9/2009 Hong et al. ..... 206/723

(Continued)

FOREIGN PATENT DOCUMENTS

JP 5-683 U 1/1993
JP H07-19169 U 4/1995

(Continued)

OTHER PUBLICATIONS

Patent Abstracts of Japan, Publication No. 2003-026232, Publication Date: Jan. 29, 2003, 1 page.

(Continued)

*Primary Examiner* — Luan K Bui
(74) *Attorney, Agent, or Firm* — Osha Liang LLP

(57) ABSTRACT

A damping body for packaging includes, between an abutment adapted to abut against a precision substrate storage container upon packaging and an outer peripheral wall rising from an outer peripheral edge of a bottom part having the abutment, an outer peripheral bottom formed at a position distanced more from the abutment than is the precision substrate storage container, and a stepped part formed between the outer peripheral bottom and the abutment. Consequently, in the event of an impact from the outside, the stepped part collapses, so that the abutment favorably moves with respect to the outer peripheral bottom and thus can efficiently absorb the impact. This can prevent large impacts from instantaneously being exerted on the precision substrate storage container and efficiently damp drop impacts.

8 Claims, 19 Drawing Sheets

U.S. PATENT DOCUMENTS

| | | | | |
|---|---|---|---|---|
| 7,810,639 | B2 * | 10/2010 | Djulaini et al. | 206/523 |
| 2001/0020595 | A1 | 9/2001 | Koike | |
| 2006/0019411 | A1 | 1/2006 | Ueda et al. | |

FOREIGN PATENT DOCUMENTS

| | | | |
|---|---|---|---|
| JP | 7-307378 | A | 11/1995 |
| JP | H11-079250 | A | 3/1999 |
| JP | 2000-159288 | A | 6/2000 |
| JP | 2001-19050 | A | 1/2001 |
| JP | 2002-160769 | A | 6/2002 |
| JP | 2003-026232 | A | 1/2003 |
| JP | 2003-174081 | A | 6/2003 |
| JP | 2004-1804 | A | 1/2004 |
| JP | 2004-168324 | A | 6/2004 |
| JP | 2007-197011 | A | 8/2007 |
| JP | 2008-150067 | A | 7/2008 |
| WO | 2005-118423 | A2 | 12/2005 |
| WO | 2007/058034 | A1 | 5/2007 |
| WO | 2008-096462 | A1 | 8/2008 |

OTHER PUBLICATIONS

Office Action for Japanese Application No. P2006-014230 mailed on Mar. 23, 2010 and Partial English translation thereof, 2 pages.

Office Action for Japanese Application No. P2006-339015 mailed on Jun. 28, 2011 and English translation thereof, 4 pages.

English translation of International Preliminary Report on Patentability mailed Aug. 20, 2009, 10 pages.

Extended European Search Report for Application No. 07768307.6-1226, mailed on Nov. 4, 2011(9 pages).

International Search Report from PCT/JP2007/063575 dated Sep. 18, 2007 (4 pages).

espacenet Abstract Publication No. JP2000159288A dated Jun. 13, 2000; Shin-Etsu Polymer Co. (1 page).

espacenet Abstract Publication No. JP7307378A dated Nov. 21, 1995; Shin-Etsu Handotai KK (1 page).

espacenet Abstract Publication No. JP2004168324A dated Jun. 17, 2004; Kanegafuchi Chemical Ind. (1 page).

espacenet Abstract Publication No. JP2003174081A dated Jun. 20, 2003; Shin-Etsu Polymer Co. (1 page).

espacenet Abstract Publication No. J2008150067A dated Jul. 3, 2008; Shin-Etsu Polymer Co. (1 page).

espacenet Abstract Publication No. JP2002160769A dated Jun. 4, 2002; Shin-Etsu Polymer Co. (1 page).

espacenet Abstract Publication No. JP2004001804A dated Jan. 8, 2004; Sharp KK; Nippon Haipatsuku KK (1 page).

espacenet Abstract Publication No. JP2001019050A dated Jan. 23, 2001; Sony Corp. (1 page).

espacenet Abstract Publication No. JP2007197011A dated Aug. 9, 2007; Shin-Etsu Polymer Co. (1 page).

Japanese Office Action issued in Japanese Application No. 2008-556988 dated Oct. 11, 2011 and English translation thereof, 4 pages.

* cited by examiner

DAMPING BODY FOR PACKAGING AND PACKAGE BODY

TECHNICAL FIELD

The present invention relates to a damping body for packaging used when packaging precision substrate storage containers for storing precision substrates such as various wafers made of silicon, glass, compounds, oxides, and the like used for producing semiconductor devices such as transistors and diodes, semiconductor circuit parts such as memories and LSI, and optical circuit parts such as CCD and semiconductor lasers; semiconductor wafers; mask glass; pellicles; liquid-crystal glass; or information storage media such as hard disk substrates and optical disks made of aluminum, glass, and the like; and a package body equipped with this damping body.

BACKGROUND ART

Known as an example of precision substrate storage containers used for transporting precision substrates is one disclosed in Patent Literature 1. This precision substrate storage container uses a retainer which projects deeply rearward from the left and right sides in order to protect precision substrates stored therein. As package bodies used for safely transporting such a precision substrate storage container, those disclosed in Patent Literatures 2 and 3 have been known, for example. Each of these package bodies uses a pair of damping bodies arranged on the upper and lower sides of the precision substrate storage container. Each damping body is provided with a storage section for storing the precision substrate storage container. Patent Literature 4 discloses a damping body shaped by using a foam member.

Meanwhile, as a requirement for safely transporting a precision substrate, it is desirable for a package body to have a drop height, by which no abnormality such as a damage occurs in a precision substrate storage container or precision substrate stored therein when the package body packaging the precision substrate is naturally dropped, of at least 1.0 m, preferably at least 1.5 m.

The precision substrate storage container described in the above-mentioned Patent Literature 1 is suitable for protecting precision substrates. However, it may be problematic in that it necessitates a dedicated apparatus for automatically attaching or removing a lid, a long stroke is necessary when removing the lid from the body of the container because of the large retainer provided therein, an extra space is required for placing a lid opening/closing apparatus, and so forth. For overcoming these problems, a precision substrate storage container in which a pullout stroke for removing the lid is on a par with that of a storage container used in a device maker's process and a lid opening/closing apparatus standardized by SEMI Standard E62, E63, etc. can be used has been developed (see Patent Literature 5). In this precision substrate storage container, however, the area where the retainer holds a precision substrate is limited to a center part, and the stroke for holding the precision substrate is short. Therefore, when packaging such a precision substrate storage container, the conventional package bodies disclosed in the above-mentioned Patent Literatures 2 to 4 cannot fully absorb impacts at the time of falling, whereby corner and ridge parts of the package bodies in particular may increase damages caused by the impacts at the time of falling. Specifically, the precision substrates break at the drop height of 0.8 m or more, thereby increasing particles. Therefore, the conventional package bodies have failed to be used for transportation.

Patent Literature 1: Japanese Patent Application Laid-Open No. 2000-159288

Patent Literature 2: Japanese Patent Application Laid-Open No. 7-307378

Patent Literature 3: Japanese Patent Application Laid-Open No. 2002-160769

Patent Literature 4: Japanese Patent Application Laid-Open No. 2004-168324

Patent Literature 5: Japanese Patent Application Laid-Open No. 2003-174081

DISCLOSURE OF INVENTION

Technical Problem

Meanwhile, polystyrene foams, urethane foams, and the like, for example, may be used in order to reinforce the above-mentioned conventional package bodies. However, the polystyrene foams, urethane foams, and the like have been problematic in that they tend to become bulky in general, thereby increasing the size of package bodies, thus necessitating large spaces for storage and transportation, which lowers the space efficiency of factories and increasing the transportation cost for collecting the damping bodies after use. Also, the damping bodies made of polystyrene foams have been problematic, for example, in that their end parts are easy to break, so that their finely divided fragments may contaminate clean rooms of the factories, while the damping bodies made of urethane foams are hard to break but have been problematic, for example, in that their foam openings are exposed at the surface and thus are easy to catch contaminants. They have also been problematic in terms of reuse and recycle in view of the problems mentioned above. It is therefore difficult for the polystyrene foams and urethane foams to be used as damping members.

Hence, for overcoming the problems mentioned above, it is an object of the present invention to provide a damping body for packaging and a package body which can efficiently absorb impacts at the time of falling.

Solution to Problem

The damping body for packaging in accordance with one aspect of the present invention is a damping body for packaging arranged on at least one of upper and lower sides of a precision substrate storage container when packaging the precision substrate storage container storing a precision substrate with a package body; the damping body comprising a bottom part covering an upper or lower face of the precision substrate storage container upon packaging, an outer peripheral wall rising from an outer peripheral edge of the bottom part, and a reinforcement formed with the outer peripheral wall; wherein the bottom part has an abutment adapted to abut against the upper or lower face of the precision substrate storage container and an outer peripheral bottom formed on an outer periphery of the abutment at a position distanced more from the precision substrate storage container than is the abutment; and wherein a stepped part is formed between the abutment and the outer peripheral bottom.

In accordance with this aspect of the present invention, between the abutment abutting against the precision substrate storage container at the time of packaging and the outer peripheral wall rising from the outer peripheral edge of the bottom part having the abutment, the outer peripheral bottom is formed at a position distanced more from the precision substrate storage container than is the abutment, while a stepped part is formed between the outer peripheral bottom and the abutment. Consequently, in the event of an impact from the outside, the stepped part collapses, so that the abutment favorably moves with respect to the outer peripheral wall and thus can absorb the impact efficiently. This can prevent large impacts from instantaneously being exerted on the precision substrate storage container and effectively damp drop impacts.

Preferably, in the damping body for packaging in accordance with this aspect of the present invention, the reinforcement is a bellows. Alternatively, the reinforcement may be a recess or protrusion having an arc-shaped cross section.

Preferably, in the damping body for packaging in accordance with this aspect of the present invention, the abutment is a pedestal projecting more to the precision substrate storage container than is the outer peripheral bottom.

Preferably, the pedestal is formed with a projection projecting away from the precision substrate storage container and reducing a diameter stepwise as the projection separates from the precision substrate storage container. Consequently, in the event of an impact from the outside, the impact can be received stepwise by the projection, so as to be mitigated. Therefore, drop impacts can be damped further effectively.

The bottom part may have an opposing portion opposing the upper or lower face of the precision substrate storage container and a projection projecting to the precision substrate storage container than is the opposing portion and reducing a diameter stepwise as the projection separates from the precision substrate storage container, while the abutment is formed by the projection.

Preferably, the stepped part is formed with an inwardly depressed arc-shaped recess or outwardly projecting arc-shaped protrusion in a plan view.

The damping body for packaging in accordance with another aspect of the present invention is a damping body for packaging arranged on at least one of upper and lower sides of a precision substrate storage container when packaging the precision substrate storage container storing a precision substrate with a package body; the damping body comprising a bottom part covering an upper or lower face of the precision substrate storage container upon packaging, an outer peripheral wall rising from an outer peripheral edge of the bottom part, and a reinforcement formed with the outer peripheral wall; wherein the bottom part has an abutment adapted to abut against the upper or lower face of the precision substrate storage container; and wherein the abutment has a projection projecting toward or away from the precision substrate storage container.

This aspect of the present invention is equipped with the abutment adapted to abut against the precision substrate storage container, while the abutment is formed with the projection projecting toward or away from the precision substrate storage container. Consequently, in the event of an impact from the outside, the projection collapses, so that the impact can efficiently be absorbed. This can prevent large impacts from instantaneously being exerted on the precision substrate storage container and effectively damp drop impacts.

Preferably, the projection reduces a diameter stepwise toward a leading end thereof. Hence, the diameter of the projection decreases stepwise as the projection separates from the precision substrate storage container when the projection projects away from the precision substrate storage container, while the diameter of the projection decreases stepwise as the projection approaches the precision substrate storage container when the projection projects toward the precision substrate storage container.

The package body of the present invention comprises the above-mentioned damping body for packaging. This aspect of the present invention comprises the above-mentioned damping body for packaging and thus can efficiently absorb impacts from the outside if any. This can prevent large impacts from instantaneously being exerted on the precision substrate storage container and effectively damp drop impacts.

Advantageous Effects of Invention

The damping body for packaging and package body in accordance with the present invention can efficiently absorb impacts at the time of falling.

REFERENCE SIGNS LIST

Figure 1:
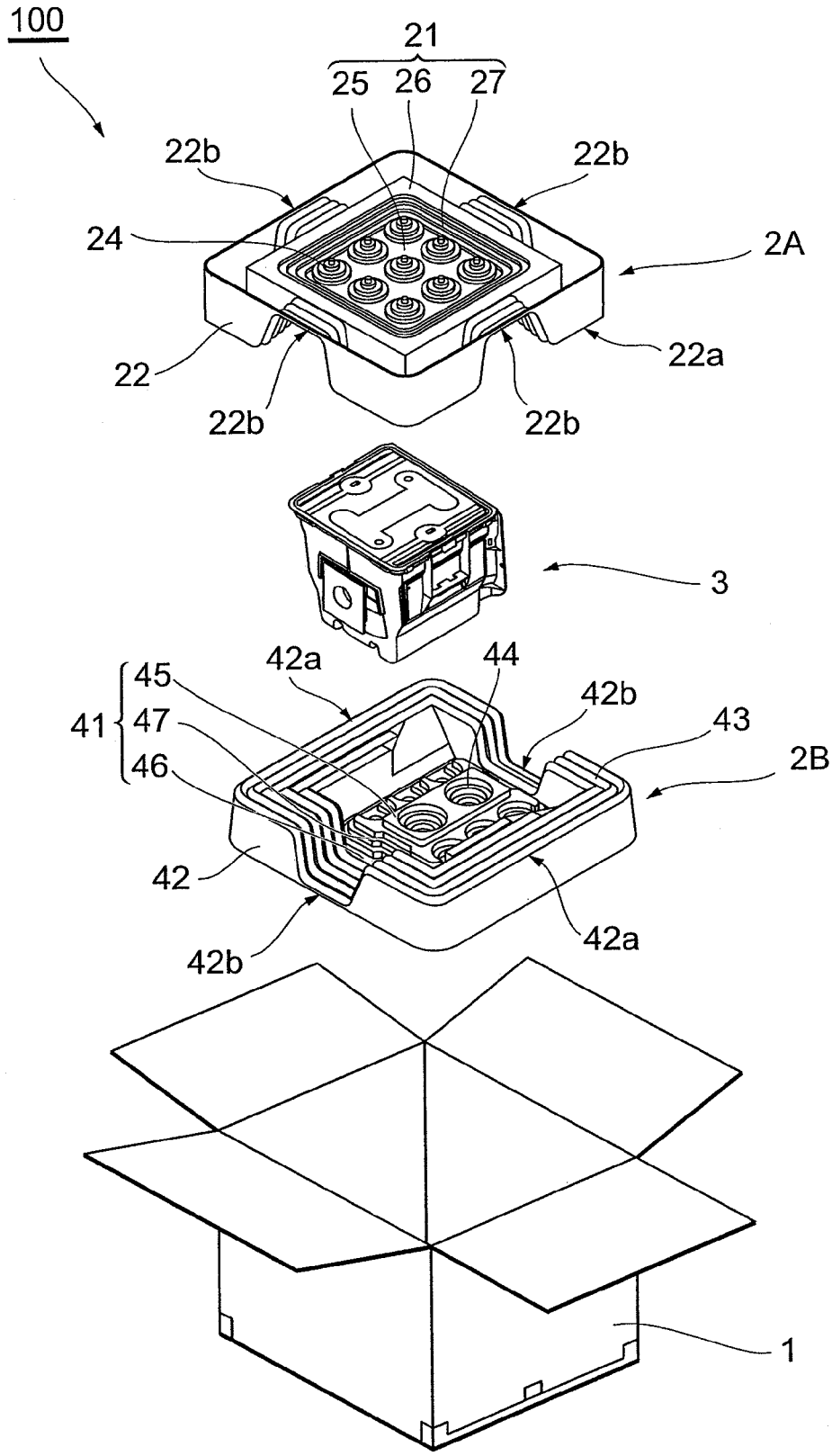
FIG. 1 is an exploded perspective view at the time of storing a precision substrate storage container in a package body in accordance with a first embodiment of the present invention.

1 . . . package box (package body); 2A, 2C . . . upper damping body (damping body for packaging); 2B . . . lower damping body (damping body for packaging); 2D, 2E . . . damping body (damping body for packaging); 3 . . . precision substrate storage container; 21, 41, 61, 71 . . . bottom part; 22, 42, 62, 72, 82 . . . outer peripheral wall; 23, 43, 63 . . . bellows (reinforcement); 24, 74 . . . projection; 25, 45, 75 . . . pedestal (abutment); 26, 46, 66, 76 . . . outer peripheral bottom; 27, 47, 67, 77 . . . stepped part; 48 . . . semicircular part (arc-shaped recess); 49 . . . semicircular part (arc-shaped protrusion); 64 . . . projection (abutment); 65 . . . opposing portion; 73, 83 . . . reinforcement recess (reinforcement)

DESCRIPTION OF EMBODIMENTS

In the following, embodiments of the damping body for packaging and package body in accordance with the present invention will be explained with reference to the drawings. In the drawings, the same constituents will be referred to with the same signs while omitting their overlapping descriptions.

Figure 2:
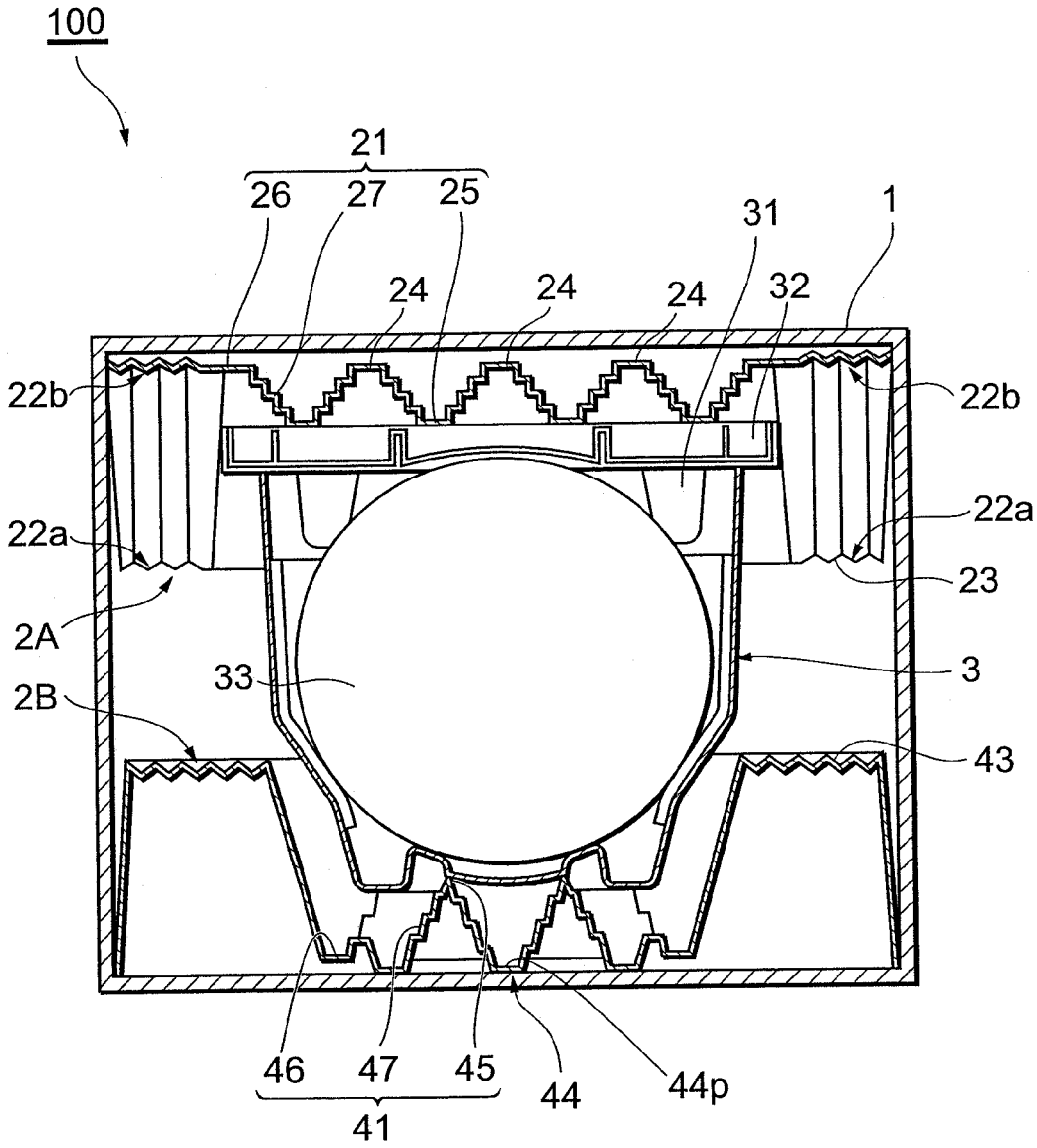
FIG. 2 is a sectional view of a state where the precision substrate storage container is stored in the package body in accordance with the first embodiment of the present invention.

FIG. 1 is an exploded perspective view at the time of storing a precision substrate storage container in the package body in accordance with the first embodiment of the present invention. FIG. 2 is a sectional view of a state where the precision substrate storage container is stored in the package body in accordance with the first embodiment of the present invention. As illustrated in FIGS. 1 and 2, a package body 100 has a package box 1, an upper damping body 2A, and a lower damping body 2B.

The package box 1 is a box for packaging a precision substrate storage container 3 when transporting the precision substrate storage container 3. The precision substrate storage container 3 is a container for storing a semiconductor wafer (precision substrate) 33. After being put into a plastic bag or aluminum-laminated bag and hermetically sealed, the precision substrate storage container 3 is packaged with the package box 1 while being held between the upper damping body 2A and lower damping body 2B.

Various cardboard boxes, boxes made of plastic resins such as polyethylene and polypropylene, and boxes made of foam materials such as polyurethane, polyethylene, and polypropylene resins, for example, can be used as the package box 1, while being formed with such dimensions that one or a plurality of precision substrate storage containers 3 can be stored therein. When made of a plastic resin in particular, the package box 1 can improve its convenience of reuse and inhibit clean rooms from being contaminated with paper dust and the like.

The upper damping body 2A is a damping body arranged on the upper side of the precision substrate storage container 3 when packaging the precision substrate storage container 3 with the package box 1, while the lower damping body 2B is a damping body arranged on the lower side of the precision substrate storage container 3 when packaging the precision substrate storage container 3 with the package box 1. They will be referred to as damping bodies 2A, 2B in the following explanation when it is not necessary for the upper and lower damping bodies to be distinguished from each other. When explaining the damping bodies 2A, 2B, the side facing the precision substrate storage container 3 will be referred to as the front side and its opposite side as the rear side.

The damping bodies 2A, 2B are shaped by known manufacturing methods such as vacuum shaping, compressed air shaping, pressure shaping, and plug-assisting of resin sheets. Examples of the resin sheets to be shaped into the damping bodies 2A, 2B include sheets made of plastics such as polyolefin-based resins and polystyrene-based resins. The thickness of the resin sheets is preferably about 0.5 to 2.0 mm, more preferably about 0.7 to 1.6 mm. The resin sheets may be doped with antistatic agents, colorants, and various additives.

Figure 3:
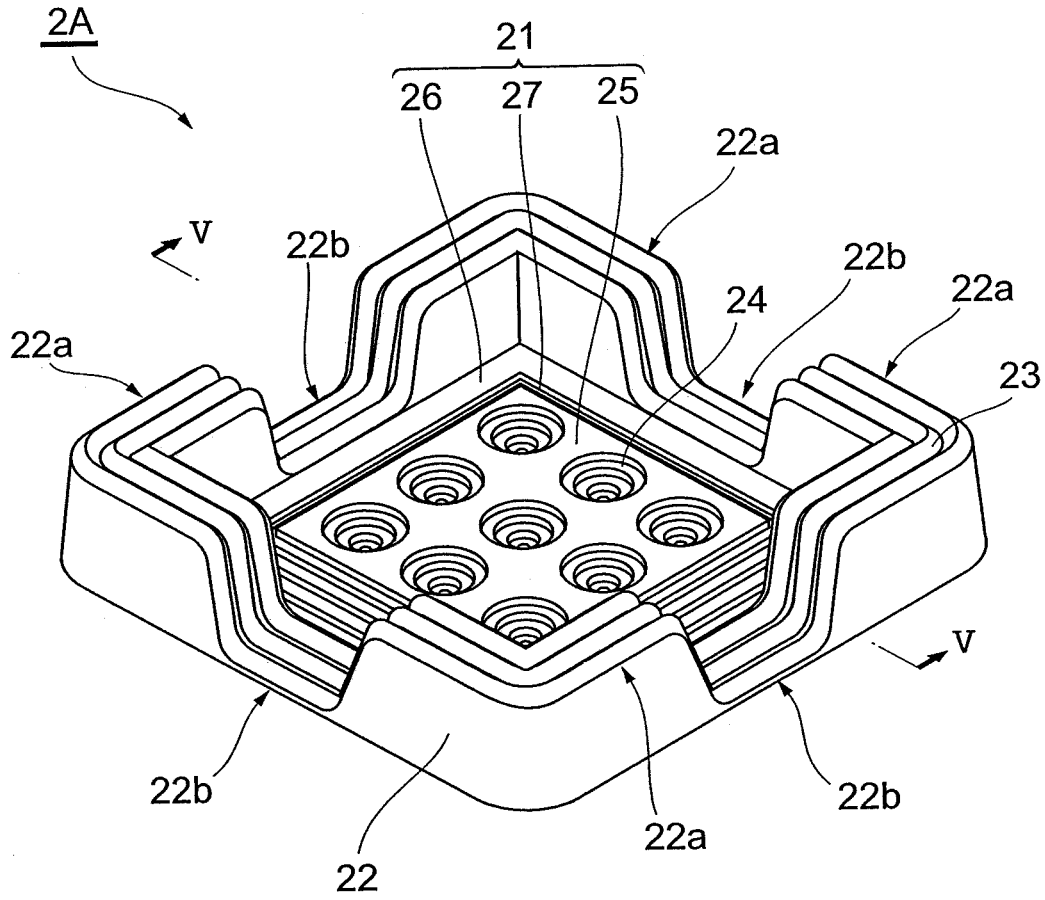
FIG. 3 is a perspective view of an upper damping body in accordance with the first embodiment of the present invention.
Figure 4:
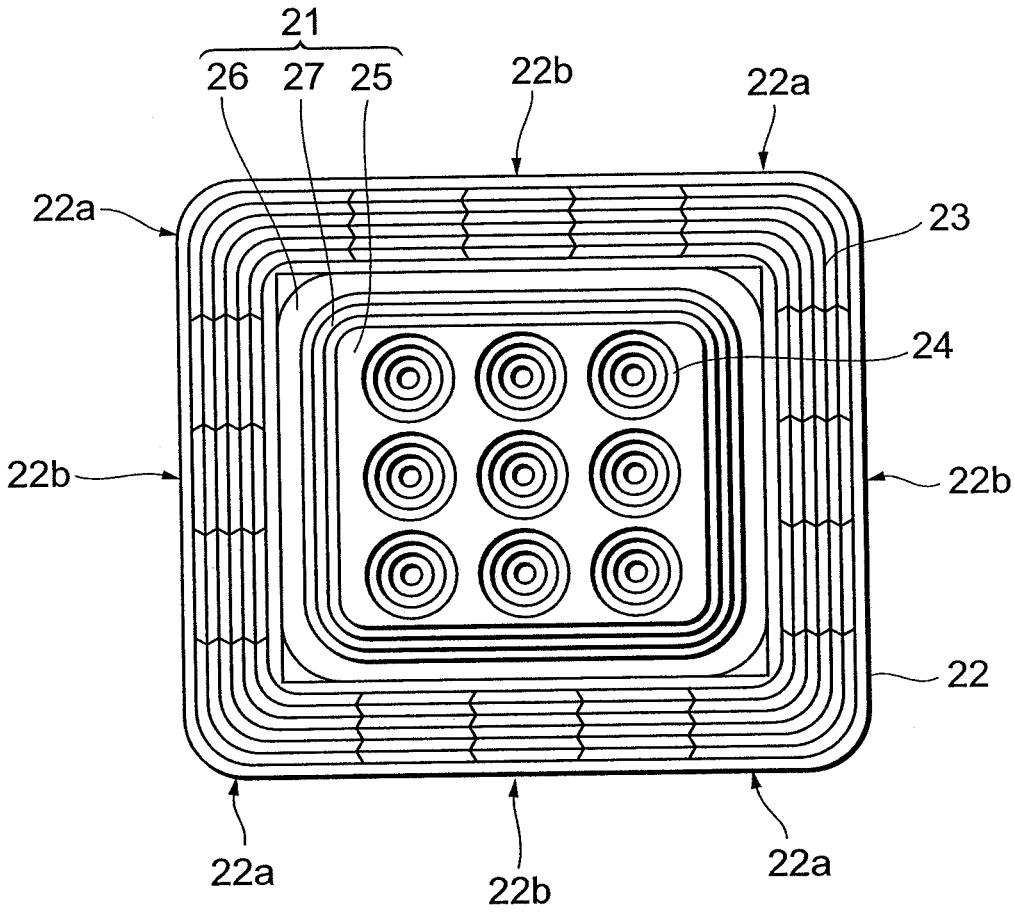
FIG. 4 is a plan view of the upper damping body in accordance with the first embodiment of the present invention.
Figure 5:
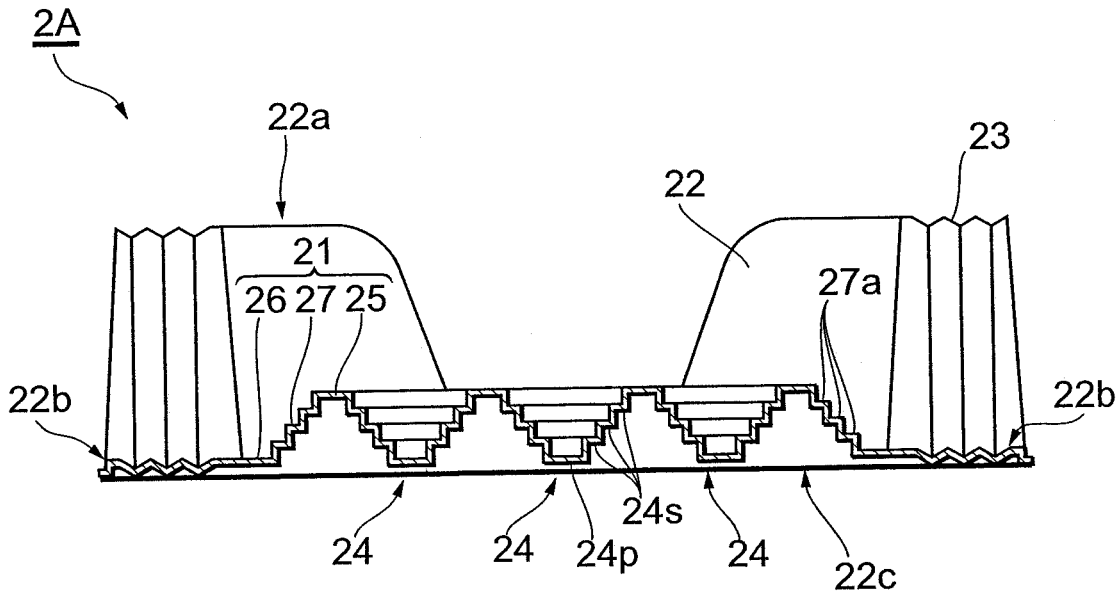
FIG. 5 is a sectional view taken along the line V-V of FIG. 3.

The upper damping body 2A will now be explained with reference to FIGS. 3 to 5. FIG. 3 is a perspective view of the upper damping body in accordance with the first embodiment of the present invention, FIG. 4 is a plan view of the upper damping body in accordance with the first embodiment of the present invention, and FIG. 5 is a sectional view taken along the line V-V of FIG. 3.

The upper damping body 2A is provided with a recess for storing the precision substrate storage container 3. This recess is formed by a bottom part 21 covering the upper face of the precision substrate storage container 3 and an outer peripheral wall 22 rising from the outer peripheral edge of the bottom part 21. The height of the outer peripheral wall 22 alternately becomes higher and lower in a repeating manner along the outer periphery. In the following, the higher parts of the outer peripheral wall 22 will be referred to as outer peripheral wall protrusions 22*a*, while the lower parts of the outer peripheral wall 22 will be referred to as outer peripheral wall recesses 22*b*. In this embodiment, four outer peripheral wall protrusions 22*a* and four outer peripheral wall recesses 22*b* are alternately provided along the outer periphery.

A bellows (reinforcement) 23 for absorbing impacts is formed at an end face (end part) of the outer peripheral wall 22. The bellows 23 is formed by three continuous triangular bent pieces, such as to surround the whole periphery of the precision substrate storage container. The triangles forming the bellows 23 have the same height. When the end face of the outer peripheral wall 22 is formed with the bellows 23, the outer peripheral wall 22 can expand/contract in the event of a lateral impact, thereby efficiently absorbing the impact. Preferably, the height of the outer peripheral wall 22 is changed such that the bellows has different height positions, whereby the outer peripheral wall 22 can expand/contract favorably.

The bottom part 21 of the upper damping body 2A comprises a pedestal (abutment) 25 adapted to abut against the upper face (lid 32) of the precision substrate storage container 3 and an outer peripheral bottom 26 formed on the outer periphery of the pedestal 25 at a position distanced more from the precision substrate storage container 3 than is the pedestal 25. Hence, the pedestal 25 is formed such as to project to the front side (upper side in FIG. 5) from the outer peripheral bottom 26. A staircase-like stepped part 27 is formed between the pedestal 25 and the outer peripheral bottom 26. The stepped part 27 is formed such as to surround the outer periphery of the pedestal 25. The stepped part 27 is constituted by a plurality of steps 27*a*, each having substantially the same height.

When thus provided such as to surround the outer periphery of the pedestal 25, the stepped part 27 can mitigate vertical impacts if any while receiving them stepwise. Hence, in the event of an impact, the whole stepped part 27 can be inhibited from collapsing at once, and the pedestal 25 can be deformed smoothly in balance without being affected by the rigid outer peripheral wall 22. This can improve the vertical (heightwise) impact absorbing capability.

The pedestal 25 of the upper damping body 2A is formed with a plurality of projections 24 projecting to the rear side. As illustrated in FIG. 3, the projections 24 are arranged in a matrix of 3 by 3 and have the same height within the range of 30 to 80 mm. Each projection 24 has four cylindrical steps 24*s*, 24*p* with respective diameters of 10 to 80 mm which decrease toward the leading end part 24*p* thereof. The steps are formed with a gap of 5 to 15 mm therebetween. The projections 24 may also have partly different heights instead of the same height.

When the projection 24 is provided with a plurality of steps 24*s*, 24*p*, the steps can have respective buckling strengths different from each other. Therefore, in the event of an impact from the outside, the projection 24 can mitigate the impact while receiving it stepwise. This can inhibit the projection 24 as a whole from collapsing at once in the event of an impact, and prevent strong impacts from being exerted on the precision substrate storage container. This can further restrain the lid 32, to which a retainer 31 holding the precision substrate is attached, from fluctuating at once, whereby particles can be reduced.

Preferably, the leading end part 24*p* of the projection 24 has a rigidity extremely lower than that of the remaining part. Preferably, the leading end part 24*p* of the projection 24 projects more to the rear side than is the outer peripheral bottom 26, so that a clearance is provided between the lower face of the leading end part 24*p* of the projection 24 and the lower end 22*c* of the outer peripheral wall 22 (the lower end 22*c* of the outer peripheral wall 22 projects below the lower face of the leading end part 24*p* of the projection 24). Such a structure can inhibit vibrations from being transmitted, so as to improve the anti-vibration performance, while enhancing the damping capability.

Figure 6:
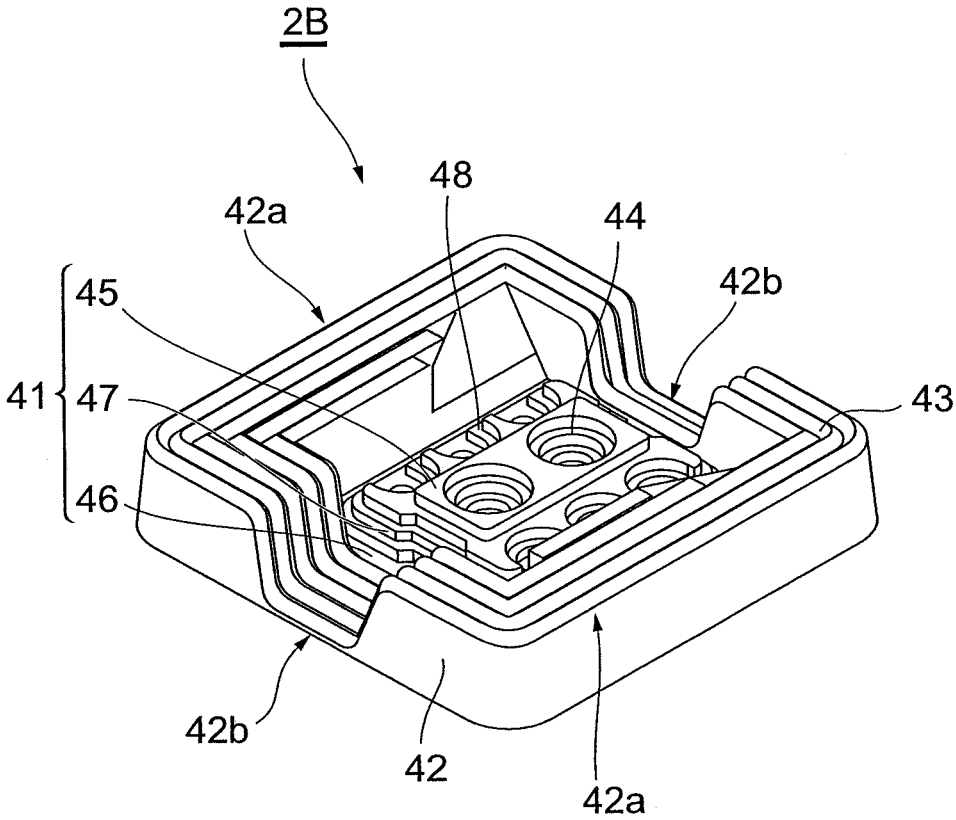
FIG. 6 is a perspective view of a lower damping body in accordance with the first embodiment of the present invention.
Figure 7:
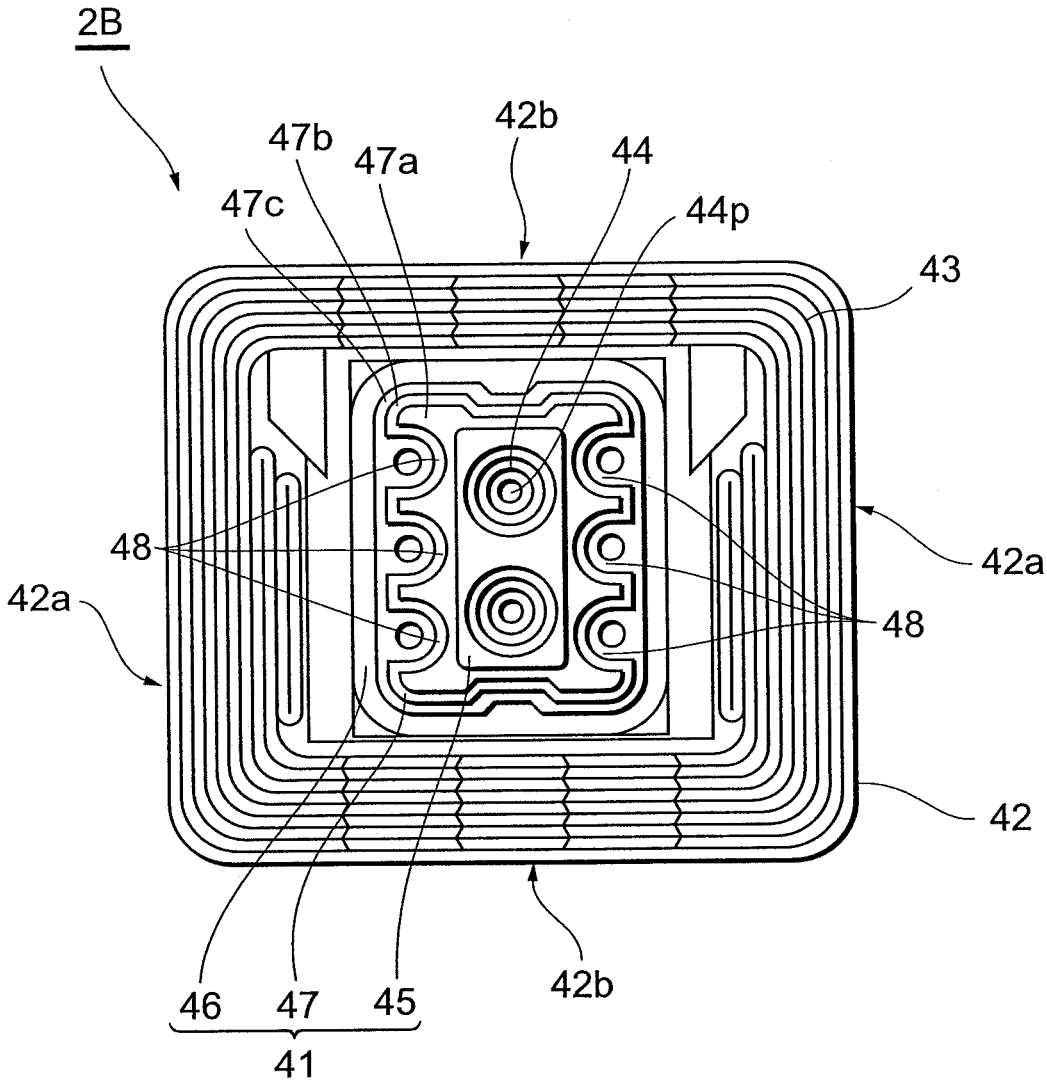
FIG. 7 is a plan view of the lower damping body in accordance with the first embodiment of the present invention.

The lower damping body 2B will now be explained with reference to FIGS. 2, 6, and 7. FIG. 6 is a perspective view of the lower damping body in accordance with the first embodiment of the present invention, while FIG. 7 is a plan view of the lower damping body in accordance with the first embodiment of the present invention.

The lower damping body 2B is provided with a recess for storing the precision substrate storage container 3. This recess is formed by a bottom part 41 covering the lower face of the precision substrate storage container 3 and an outer peripheral wall 42 rising from the outer peripheral edge of the bottom part 41. The height of the outer peripheral wall 42 repeatedly becomes higher and lower along the outer periphery. In the following, the higher parts of the outer peripheral wall 42 will be referred to as outer peripheral protrusions 42*a*, while the lower parts of the outer peripheral wall 42 will be referred to as outer peripheral recesses 42*b*. In this embodiment, a pair of outer peripheral recesses 42*b* are arranged such as to oppose each other.

A bellows (reinforcement) 43 for absorbing impacts is formed at an end face (end part) of the outer peripheral wall 42. The bellows 43 is formed by three continuous triangular bent pieces, such as to surround the whole periphery of the precision substrate storage container. The triangles forming the bellows 43 have the same height. When the end face of the outer peripheral wall 42 is formed with the bellows 43, the outer peripheral wall 42 can expand/contract in the event of a lateral impact, thereby efficiently absorbing the impact. Preferably, the height of the outer peripheral wall 42 is changed such that the bellows 43 has different height positions, whereby the outer peripheral wall 42 can expand/contract favorably.

Figure 19:
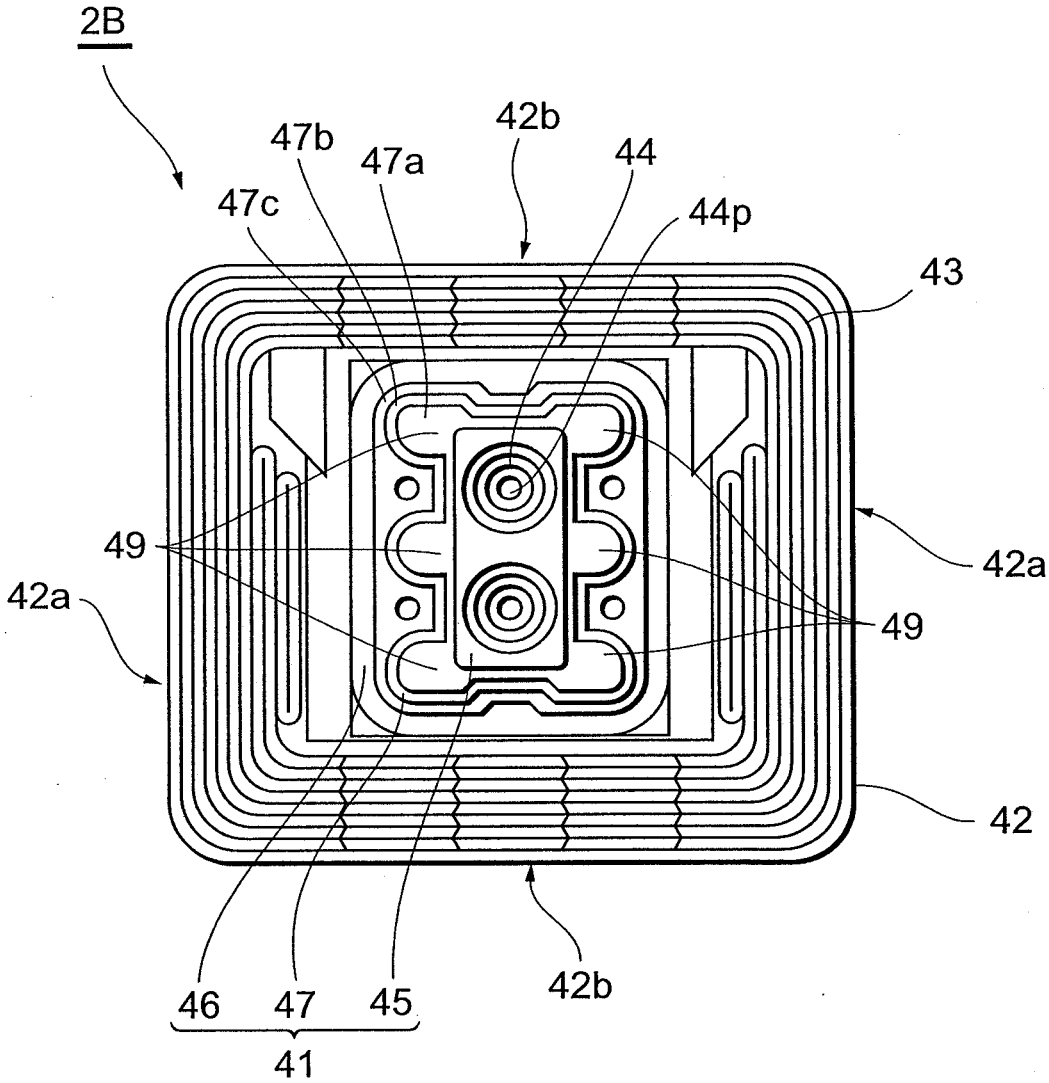
FIG. 19 is a plan view of the damping body formed with a stepped part in accordance with a modified example of the present invention.

The bottom part 41 of the lower damping body 2B comprises a pedestal (abutment) 45 adapted to abut against the lower face of the precision substrate storage container 3 and an outer peripheral bottom 46 formed on the outer periphery of the pedestal 45 at a position distanced more from the precision substrate storage container 3 than is the pedestal 45. Hence, the pedestal 45 is formed such as to project to the front side (depicted upper side) from the outer peripheral bottom 46. A staircase-like stepped part 47 is formed between the pedestal 45 and the outer peripheral bottom 46. The stepped part 47 is formed such as to surround the outer peripheral of the pedestal 45. The stepped part 47 is constituted by a plurality of steps 47*a*, 47*b*, 47*c*. Here, the steps 47*a*, 47*b*, 47*c* are arranged in this order from the pedestal 45 toward the outer peripheral bottom 46. The steps 47*a*, 47*b* have semicircular parts 48 depressed inwardly in a plan view. A plurality of (3 in this embodiment) semicircular parts 48 are arranged in each of a pair of sides opposing each other. The semicircular parts 48 may be replaced by semicircular parts 49 protruding outward in a plan view as illustrated in FIG. 19.

When thus provided such as to surround the outer periphery of the pedestal 45, the stepped part 47 can mitigate vertical impacts if any while receiving them stepwise. Hence, in the event of an impact, the whole stepped part 47 can be inhibited from collapsing at once, and the pedestal 45 can be deformed smoothly in balance without being affected by the rigid outer peripheral wall 42. This can improve the vertical (heightwise) impact absorbing capability.

The pedestal 45 of the lower damping body 2B is provided with a plurality of projections 44 projecting to the rear side of the outer peripheral wall 42. As illustrated in FIG. 7, two projections 44 are arranged in a row and have the same height within the range of 30 to 80 mm. Each projection 44 has four cylindrical steps with respective diameters of 10 to 80 mm which decrease toward a leading end part 44*p* thereof. The steps are formed with a gap of 5 to 15 mm therebetween.

When the projection 44 is provided with a plurality of steps, the steps can have respective buckling strengths different from each other. Therefore, in the event of an impact from the outside, the projection 44 can mitigate the impact while receiving it stepwise. This can inhibit the projection 44 as a whole from collapsing at once in the event of an impact, and prevent strong impacts from being exerted on the precision substrate storage container. This can further restrain the lid 32, to which the retainer 31 holding the precision substrate is attached, from fluctuating at once, whereby particles can be reduced.

Preferably, the leading end part 44*p* of the projection 44 has a rigidity extremely lower than that of the remaining part. Preferably, the leading end part 44*p* of the projection 44 projects more to the rear side than is the outer peripheral bottom 46. Employing such a structure can inhibit vibrations from being transmitted, so as to improve the anti-vibration performance.

Thus, in the damping bodies 2A, 2B, the bottom parts 21, 41 of recesses for storing the precision substrate storage container are formed with the abutments 25, 45, stepped parts 27, 47, and outer peripheral bottoms 26, 46, while the abutments 25, 45 are formed such as to project from the outer peripheral bottom parts 26, 46 to the front side through the stepped parts 27, 47. This allows the stepped parts 27, 47 to collapse gradually in the event of a vertical impact; otherwise, one impact collapses all of the plurality of steps in the stepped parts 27, 47, so that the impact damping force (impact absorbing capability) is lost. Therefore, no strong impacts will be exerted on the precision substrate storage container 3, whereby impacts onto the lid 32 closing the opening of the precision substrate storage container 3 can be mitigated. Since vibrations and impacts onto the retainer holding the substrate can be alleviated, particles are prevented from increasing on the substrate.

Such package body 100 has a sufficient impact damping force as a package body for a precision substrate storage container having a lid with a built-in automated latch mechanism and can prevent a precision substrate (wafer) from being damaged, derailing, and increasing particles even in a 150-cm drop test which has been considered difficult for conventional package bodies to adopt. Also, a vibration test has verified that the precision substrate does not move rotationally, and the inside of the precision substrate storage container can be prevented from being contaminated. Therefore, the precision substrate storage container can be transported safely.

When the damping bodies 2A, 2B are colored, initial production articles and the like can separately be managed in the event of a spec change and the like. Shaping a resin sheet with a female mold can improve the strength of the damping bodies 2A, 2B while keeping the thickness of their bottom and corner parts, and reduce the amount of stretching the bottom and corner parts, so as to keep the thickness of the resin sheet before the shaping.

Figure 11:
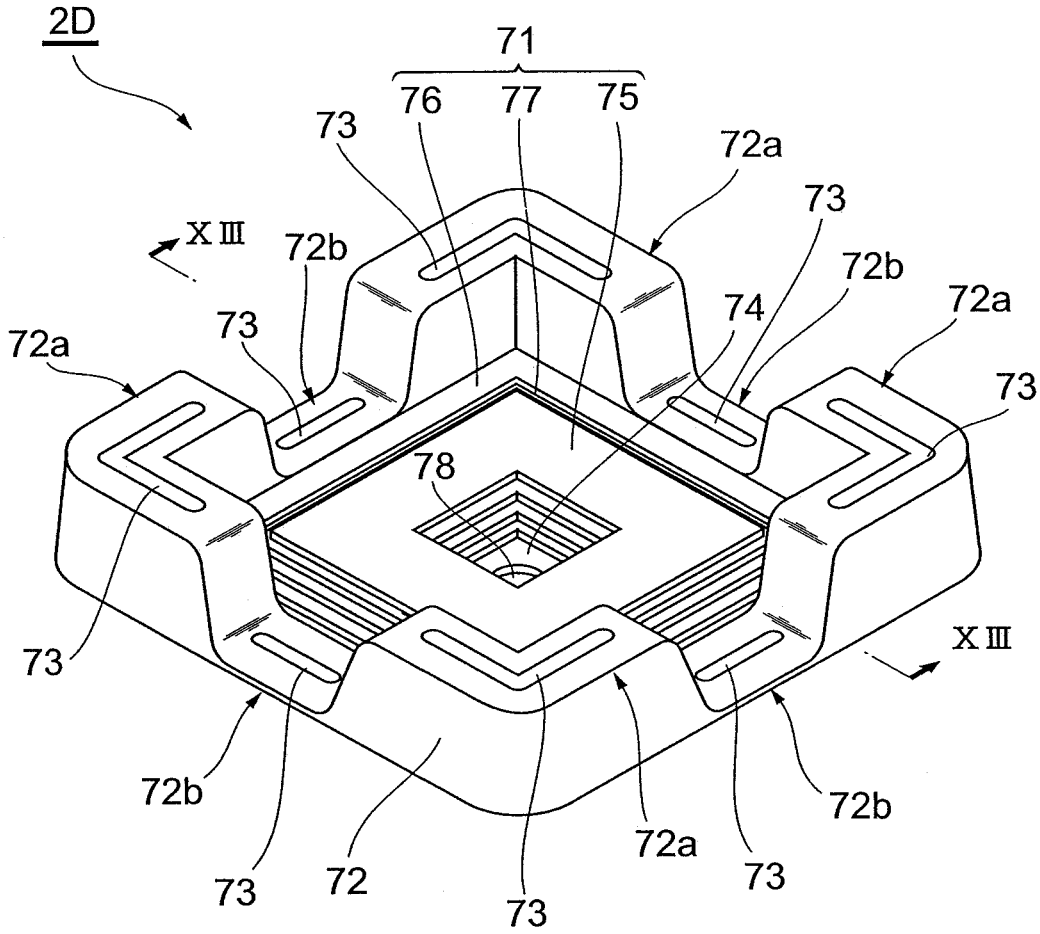
FIG. 11 is a perspective view of the damping body in accordance with a second embodiment of the present invention.
Figure 12:
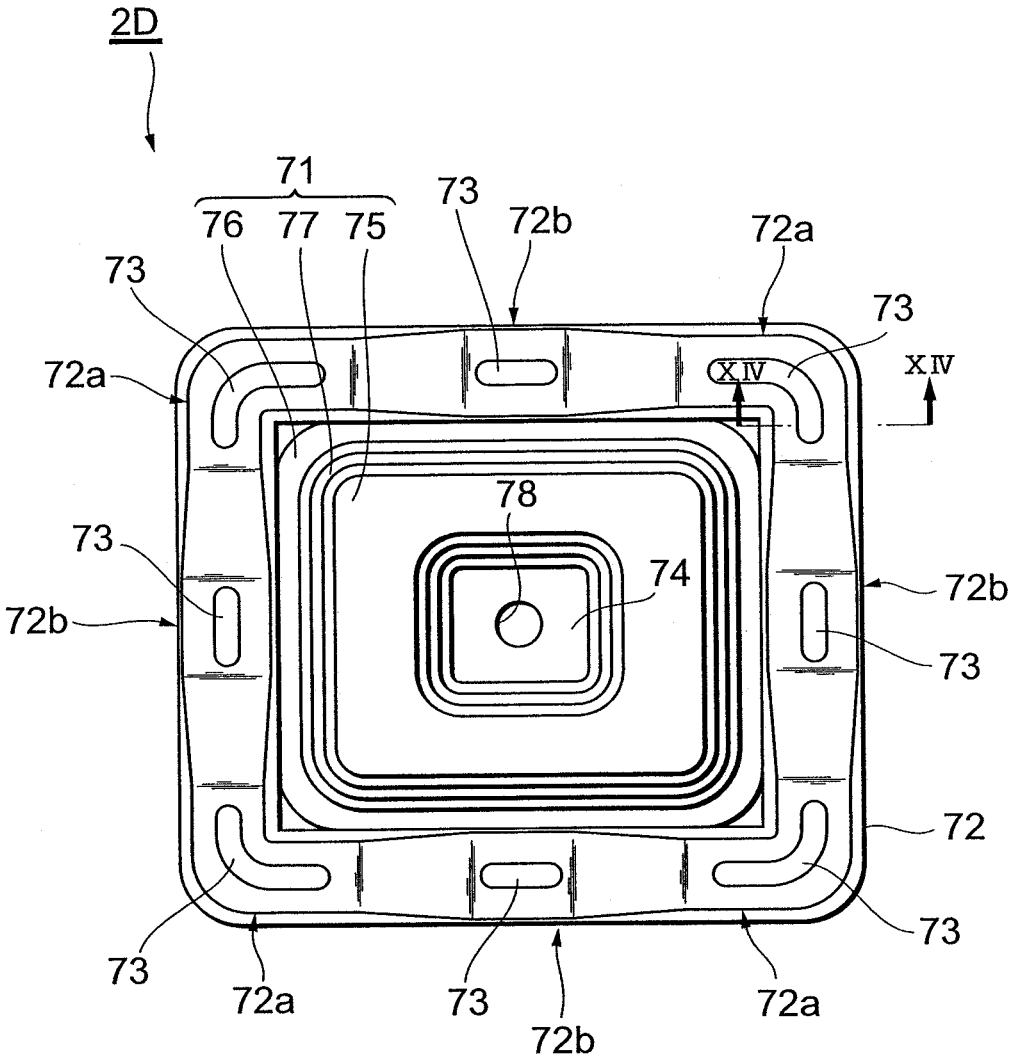
FIG. 12 is a plan view of the damping body in accordance with the second embodiment of the present invention.
Figure 13:
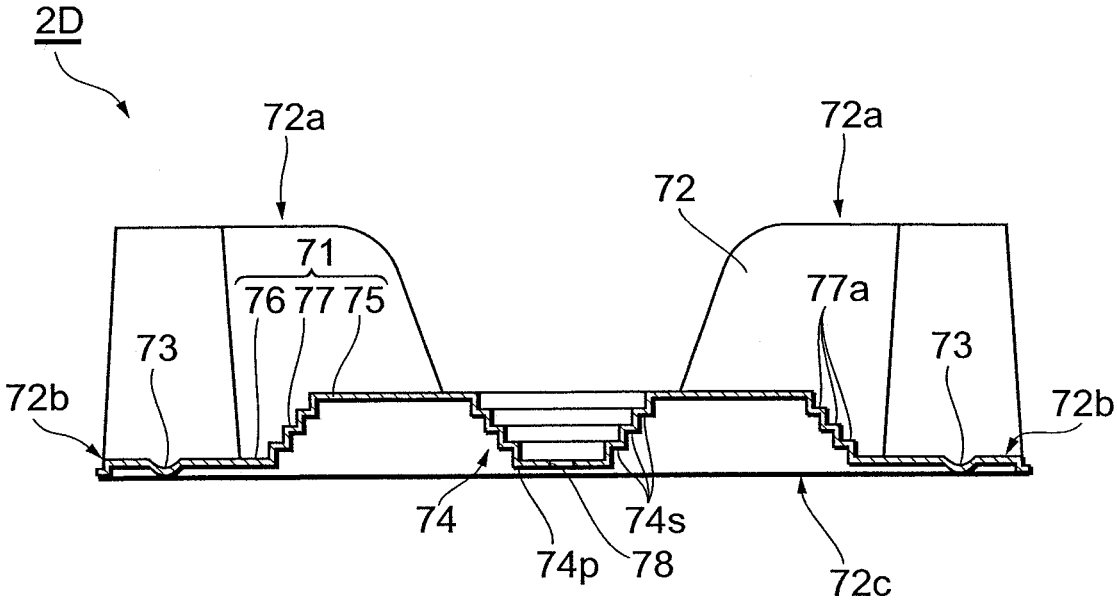
FIG. 13 is a sectional view taken along the line XIII-XIII of FIG. 11.
Figure 14:
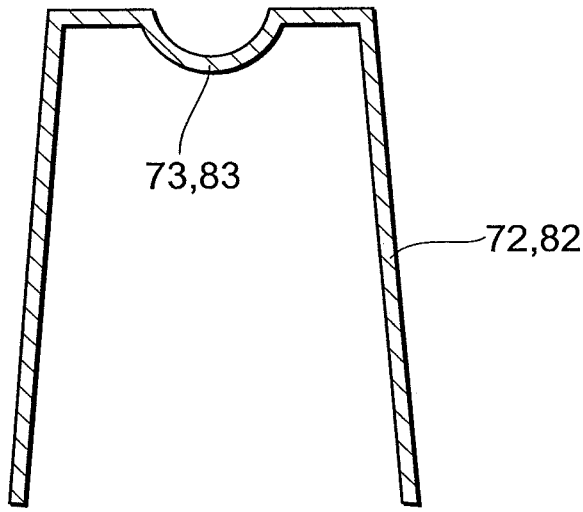
FIG. 14 is a sectional view taken along the line XIV-XIV of FIG. 12.

A damping body 2D in accordance with the second embodiment of the present invention will now be explained with reference to FIGS. 11 to 14. FIG. 11 is a perspective view of the damping body in accordance with the second embodiment of the present invention, FIG. 12 is a plan view of the damping body in accordance with the second embodiment of the present invention, FIG. 13 is a sectional view taken along the line XIII-XIII of FIG. 11, and FIG. 14 is a sectional view taken along the line XIV-XIV of FIG. 12. The damping body 2D is one which is arranged on at least one of the upper and lower sides of the precision substrate storage container 3 when packaging the precision substrate storage container 3 with the package box 1. In the explanation of the damping body 2D, the precision substrate storage container 3 side will be referred to as the front side and its opposite side as the rear side.

The damping body 2D is provided with a recess for storing the precision substrate storage container 3. This recess is formed by a bottom part 71 covering the upper or lower face of the precision substrate storage container 3 and an outer peripheral wall 72 rising from the outer peripheral edge of the bottom part 71. The height of the outer peripheral wall 72 alternately becomes higher and lower in a repeating manner along the outer periphery. In the following, the higher parts of the outer peripheral wall 72 will be referred to as outer peripheral wall protrusions 72*a*, while the lower parts of the outer peripheral wall 72 will be referred to as outer peripheral wall recesses 72*b*. In this embodiment, four outer peripheral wall protrusions 72*a* and four outer peripheral wall recesses 72*b* are alternately provided along the outer periphery.

An end face of the outer peripheral wall 72 is formed with a plurality of reinforcement recesses (reinforcements) 73. As illustrated in FIG. 14, each reinforcement recess 73 has an arc-shaped (semicircular) cross section so as to be depressed downward, while being formed like a line in a plan view. The reinforcement recesses 73 are formed such as to partly surround the outer periphery of the precision substrate storage container 3. When the end face of the outer peripheral wall 72 is formed with the reinforcement recesses 73, the outer peripheral wall 72 can expand/contract in the event of a lateral impact, thereby efficiently absorbing the impact.

The bottom part 71 of the damping body 2D comprises a pedestal (abutment) 75 adapted to abut against the upper face (lid 32) or lower face of the precision substrate storage container 3 and an outer peripheral bottom 76 formed on the outer periphery of the pedestal 75 at a position distanced more from the precision substrate storage container 3 than is the pedestal 75. Hence, the pedestal 75 is formed such as to project to the front side (upper side in FIG. 12) from the outer peripheral bottom 76. A staircase-like stepped part 77 is formed between the pedestal 75 and the outer peripheral bottom 76. The stepped part 77 is formed such as to surround the outer periphery of the pedestal 75. The stepped part 77 is constituted by a plurality of steps 77*a*, each having substantially the same height.

When thus provided such as to surround the outer periphery of the pedestal 75, the stepped part 77 can mitigate vertical impacts if any while receiving them stepwise. Hence, in the event of an impact, the whole stepped part 77 can be inhibited from collapsing at once, and the pedestal 75 can be deformed smoothly in balance without being affected by the rigid outer peripheral wall 72. This can improve the vertical (heightwise) impact absorbing capability.

The pedestal 75 of the damping body 2D is formed with a projection 74 projecting to the rear side. The projection 74 is arranged at the center of the pedestal 75 and has a rectangular form in a plan view. The projection 74 has four steps 74*s* (see FIG. 13). Preferably, the steps are formed with a gap of 5 to 15 mm therebetween. A through hole 78 is formed at the center of a leading end part 74*p* of the projection 74.

When the projection 74 is provided with a plurality of steps 74*s*, 74*p*, the steps 74*s*, 74*p* can have respective buckling strengths different from each other. Therefore, in the event of an impact from the outside, the projection 74 can mitigate the impact while receiving it stepwise. This can inhibit the projection 74 as a whole from collapsing at once in the event of an impact, and prevent strong impacts from being exerted on the precision substrate storage container 3. This can further restrain the lid 32, to which the retainer 31 (see FIG. 2) holding the precision substrate is attached, from fluctuating at once, whereby particles can be reduced.

Preferably, the leading end part 74*p* of the projection 74 has a rigidity extremely lower than that of the remaining part. Preferably, the leading end part 74*p* of the projection 74 projects more to the rear side than is the outer peripheral bottom 76. Preferably, a clearance is provided between the lower face of the leading end part 74*p* of the projection 74 and the lower end 72*c* of the outer peripheral wall 72. Such a structure can inhibit vibrations from being transmitted, so as to improve the anti-vibration performance, while enhancing the damping capability.

The pedestal 75 is also formed such as to project from the outer peripheral bottom 76 to the front side through the stepped part 77 in such damping body 2D of this embodiment. This allows the stepped part 77 to collapse gradually in the event of a vertical impact; otherwise, one impact collapses all of the plurality of steps in the stepped part 77, so that the impact damping force (impact absorbing capability) is lost. Therefore, no strong impacts will be exerted on the precision substrate storage container 3, whereby impacts onto the lid closing the opening of the precision substrate storage container 3 can be mitigated. Since vibrations and impacts onto the retainer holding the substrate can be alleviated, particles are prevented from increasing on the substrate. Thus, the damping body 2D of the second embodiment also yields operations and effects similar to those of the damping bodies 2A, 2B of the first embodiment.

Figure 15:
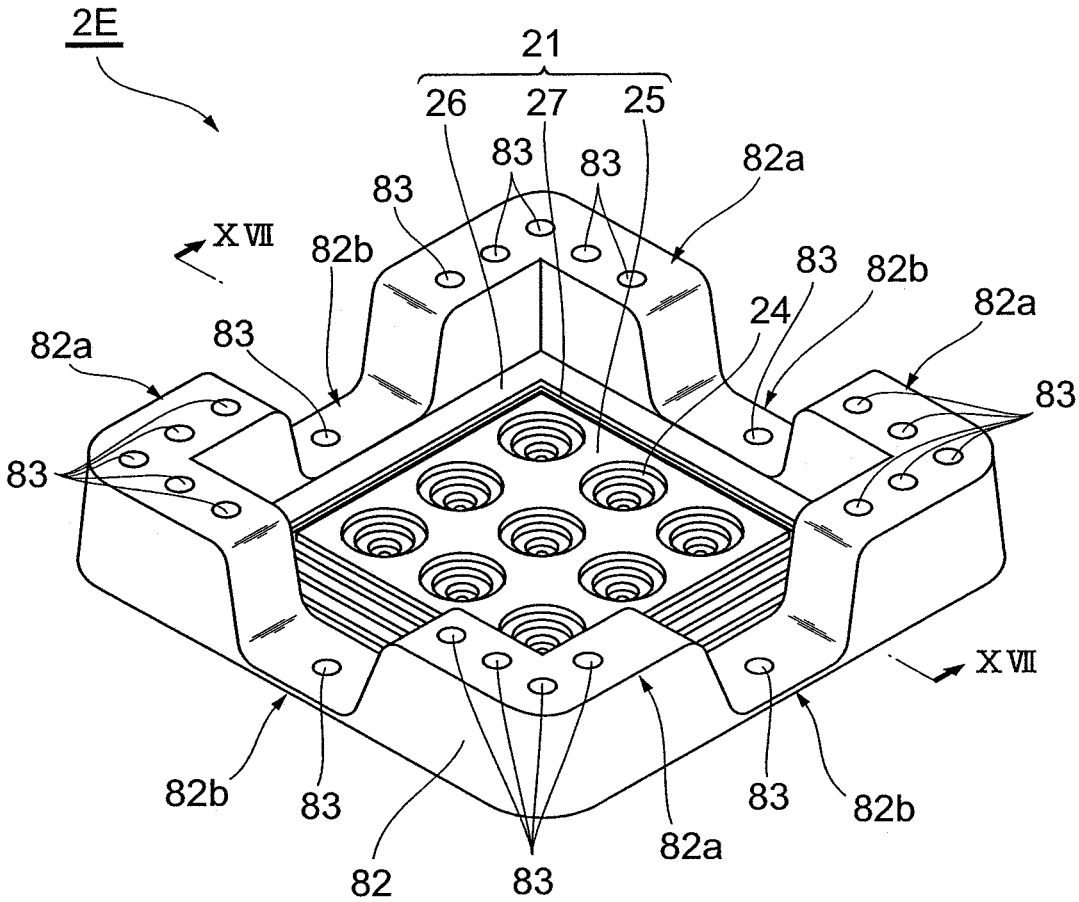
FIG. 15 is a perspective view of the damping body in accordance with a third embodiment of the present invention.
Figure 16:
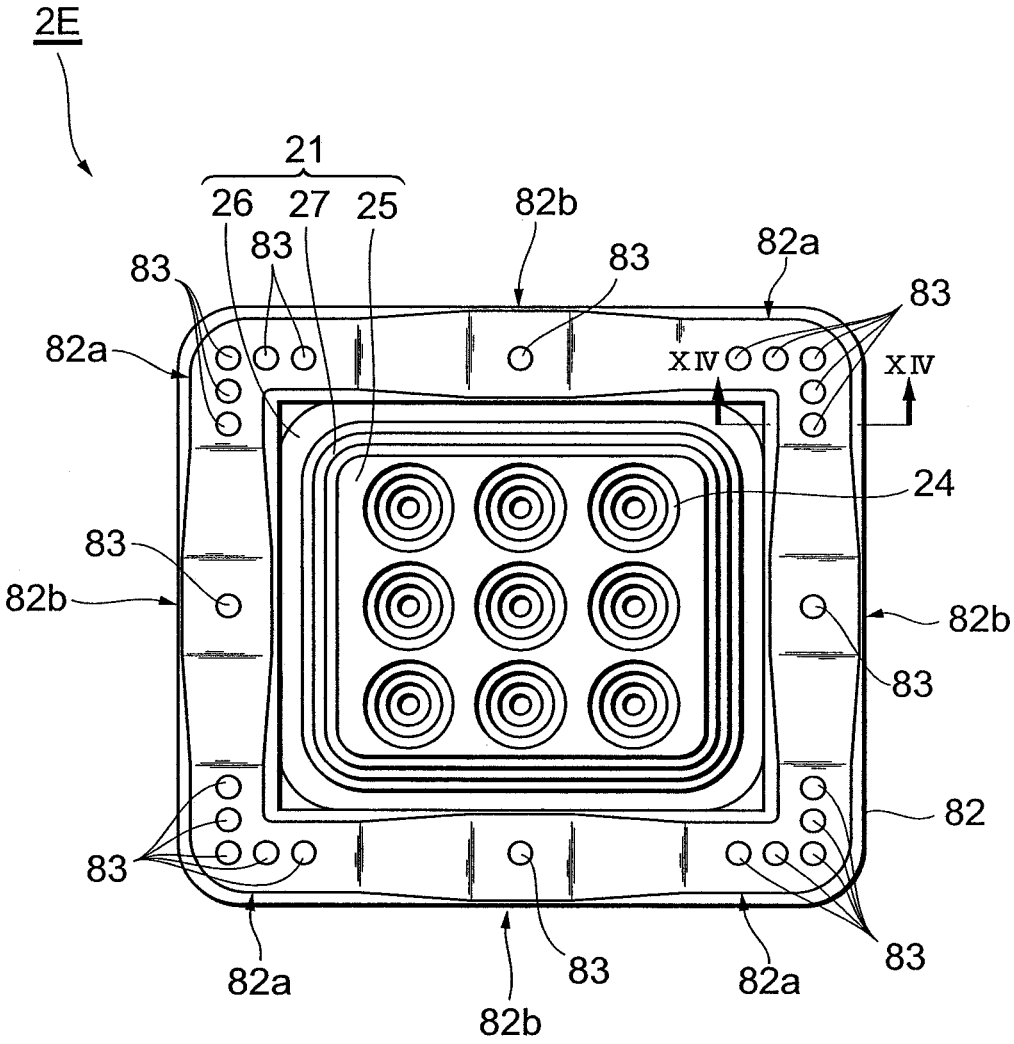
FIG. 16 is a plan view of the damping body in accordance with the third embodiment of the present invention.
Figure 17:
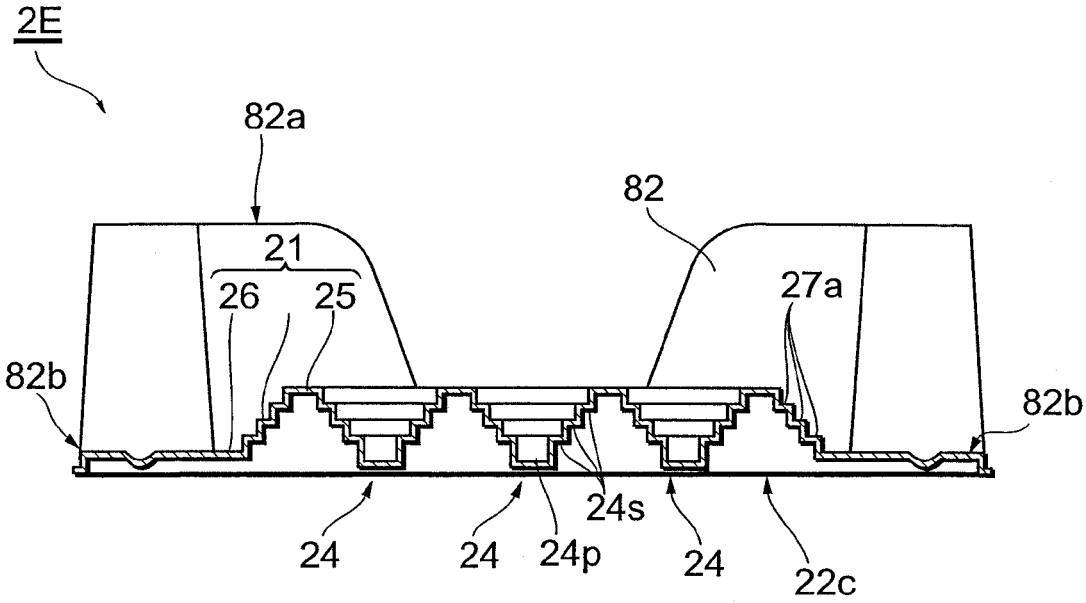
FIG. 17 is a sectional view taken along the line XVII-XVII of FIG. 15.

A damping body 2E in accordance with the third embodiment of the present invention will now be explained with reference to FIGS. 15 to 17. FIG. 15 is a perspective view of the damping body in accordance with the third embodiment of the present invention, FIG. 16 is a plan view of the damping body in accordance with the third embodiment of the present invention, and FIG. 17 is a sectional view taken along the line XVII-XVII of FIG. 15. The damping body 2E is one which is arranged on at least one of the upper and lower sides of the precision substrate storage container 3 when packaging the precision substrate storage container 3 with the package box 1. The damping body 2E of the third embodiment differs from the upper damping body 2A of the first embodiment in terms of the structure of reinforcements formed with the outer peripheral wall in that it comprises an outer peripheral wall 82 formed with reinforcement recesses 83 instead of the outer peripheral wall 22 formed with the bellows 23. The other structures are equivalent to those of the upper damping body 2A and thus will be referred to with the same signs, while omitting their overlapping explanations.

As with the outer peripheral wall 22, the outer peripheral wall 82 rises from the outer peripheral edge of the bottom part 21. The height of the outer peripheral wall 82 alternately becomes higher and lower in a repeating manner along the outer periphery, thereby yielding outer peripheral wall protrusions 82*a*, which are higher parts of the outer peripheral wall 82, and outer peripheral wall recesses 82*b*, which are lower parts of the outer peripheral wall 82.

An end face of the outer peripheral wall 82 is formed with a plurality of reinforcement recesses (reinforcements) 83 for absorbing impacts. Each reinforcement recess 83 is formed circular in a plan view, while having an arc-shaped (semicircular) cross section depressed downward. A plurality of reinforcement recesses 83 are arranged at predetermined intervals along the longitudinal direction of the end face of the outer peripheral wall 82. When the end face of the outer peripheral wall 82 is formed with the reinforcement recesses 83, the outer peripheral wall 82 can expand/contract in the event of a lateral impact, thereby efficiently absorbing the impact. Thus constructed damping body 2E of the third embodiment also yields operations and effects similar to those of the damping bodies 2A, 2B of the first embodiment.

The present invention is specifically explained with reference to its embodiments in the foregoing but should not be restricted thereto. The package body comprises the upper and lower damping bodies 2A, 2B in the above-mentioned embodiments but may comprise at least one of them. For example, the upper damping body 2A may be provided, while another damping body having a bottom part with irregularities is used on the bottom side (the side opposite from the lid) of the precision substrate storage container 3.

Figure 8:
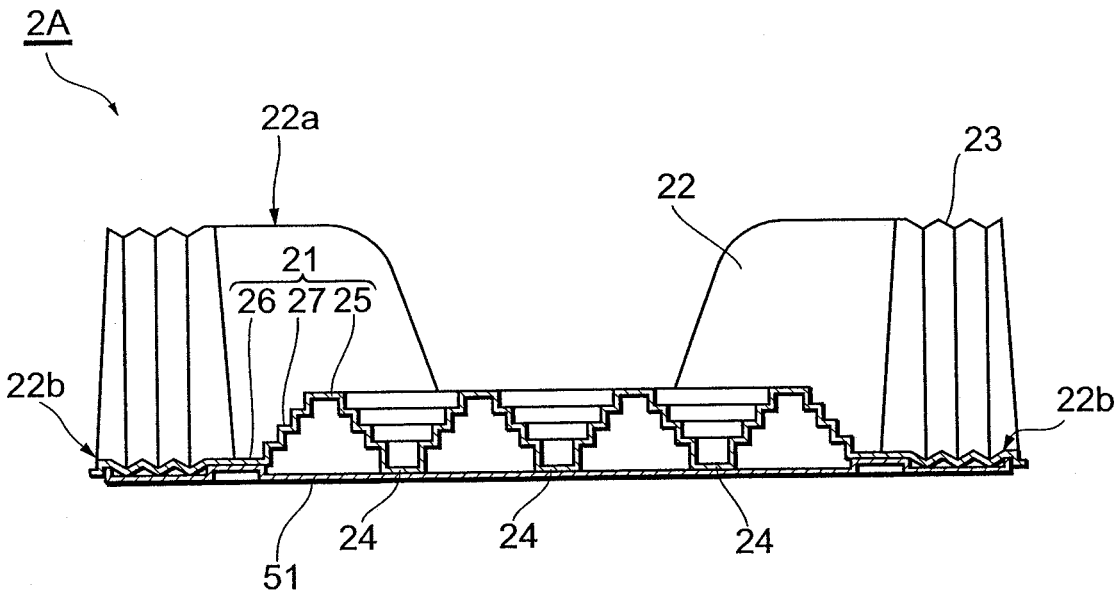
FIG. 8 is a sectional view of an upper damping body equipped with a reinforcement.

For improving the strength of the upper damping body 2A, for example, a reinforcement 51 may be attached to the rear side of the upper damping body 2A as illustrated in FIG. 8. The reinforcement 51 has a planar form with dimensions corresponding to the opening on the rear side of the upper damping body 2A. This reinforcement is arranged such as to abut against the rear faces of the projections 24 and outer peripheral bottom 26.

The package bodies in the embodiments can exhibit a sufficient impact damping force even when packaging the precision substrate storage container disclosed in the above-mentioned Patent Literature 5. Specifically, it was verified that abnormalities such as damages and derailing of semiconductor wafers and increases in particles did not occur in a 150-cm drop test which was difficult for the conventional package bodies disclosed in the above-mentioned Patent Literatures 2 to 4 to adopt. In a vibration test, it was also verified that the semiconductor wafers were kept from rotating and incurred no contamination. Therefore, precision substrate storage containers can safely be transported by using the package bodies in the embodiments.

The upper damping bodies 2A can be stored in a nested state, so as to reduce their storage space and cut down the transportation cost at the time of reuse.

Figure 9:
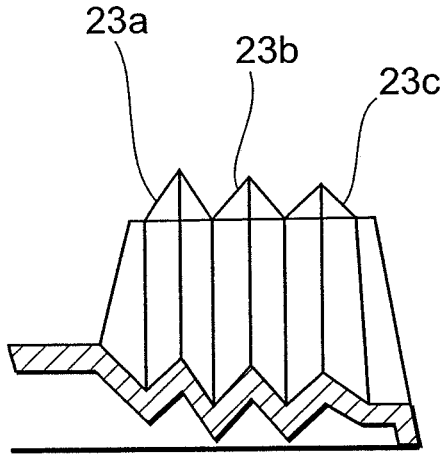
FIG. 9 is an enlarged sectional view illustrating a modified example of a bellows in accordance with the present invention.

Though the triangles forming the bellows 23 in the above-mentioned embodiment are formed with the same height, this is not limitative. For example, as illustrated in FIG. 9, the triangles 23*a*, 23*b*, 23*c* forming the bellows may gradually increase their height from the inside to the outside. The triangles forming the bellows may gradually decrease their height from the inside to the outside. Forming such bellows 23 can gradually change the compressive strength thereof. Therefore, in the event of an impact, it can be mitigated while being received stepwise by different heights of the bellows 23, whereby the impact absorbing capability can further be improved. Such a structure is also effective in absorbing vibrations when packaging and transporting a precision substrate storage container.

Without being restricted to three continuous triangular bent pieces in the above-mentioned embodiment, it will be sufficient if the bellows 23 is formed by a plurality of bent pieces, which may be not only triangular but also polygonal or wavy.

It will be sufficient for the bellows 23 to be formed in at least a part of the periphery of the precision substrate storage container instead of surrounding the whole periphery as mentioned above. However, it can absorb impacts more when provided in the whole periphery.

Figure 10:
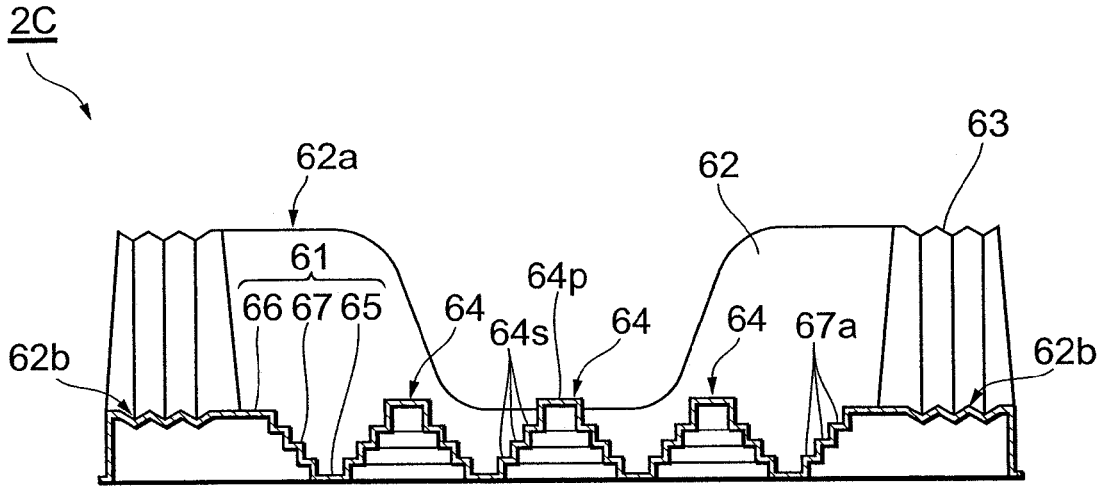
FIG. 10 is a sectional view of the upper damping body in accordance with another embodiment of the present invention.

Though the projections 24 in the above-mentioned embodiment project in a direction opposite from the rising direction of the outer peripheral wall 22, the projecting direction of the projections 24 is not limited thereto. For example, as illustrated in FIG. 10, an upper damping body 2C may comprise projections 64 projecting in the same direction as the rising direction of the outer peripheral wall 22. The upper damping body 2C will now be explained as another embodiment.

FIG. 10 is a sectional view of the upper damping body in accordance with another embodiment. The upper damping body 2C is formed by a bottom part 61 covering the upper face of the precision substrate storage container 3 and an outer peripheral wall 62 rising from the outer peripheral edge of the bottom part 61. The height of the outer peripheral wall 62 alternately becomes higher and lower in a repeating manner along the outer periphery, thereby yielding outer peripheral wall protrusions 62*a*, which are higher parts of the outer peripheral wall 62, and outer peripheral wall recesses 62*b*, which are lower parts of the outer peripheral wall 62. Four outer peripheral wall protrusions 62*a* and four outer peripheral wall recesses 62*b* are alternately provided along the outer periphery, while an end face (end part) of the outer peripheral wall 62 is formed with a bellows 63 for absorbing impacts.

The bottom part 61 of the upper damping body 2C comprises an opposing portion 65 opposing the upper face of the precision substrate storage container 3 and an outer peripheral bottom 66 formed on the outer periphery of the opposing portion 65. The opposing portion 65 is formed at a position distanced more from the precision substrate storage container 3 than is the outer peripheral bottom 66. Hence, the opposing portion 65 is formed such as to be depressed from the outer peripheral bottom 66 to the rear side. A staircase-like stepped part 67 is formed between the opposing portion 65 and the outer peripheral bottom 66. This stepped part 67 is formed such as to surround the outer periphery of the opposing portion 65. The stepped part 67 is constituted by a plurality of steps 67*a*, each having substantially the same height.

The opposing portion 65 of the upper damping body 2C is formed with a plurality of projections 64 projecting to the front side (in a direction approaching the precision substrate storage container). The projections 64 are arranged in a matrix of 3 by 3 and have the same height within the range of 30 to 80 mm. Each projection 64 has four cylindrical steps 64*s*, 64*p* with respective diameters of 10 to 80 mm which decrease toward the leading end part 64*p* thereof. The steps are formed with a gap of 5 to 15 mm therebetween. The leading end part 64*p* of the projection 64 corresponds to the abutment of the present invention. Hence, the leading end part 64*p* of the projection 64 is formed closer to the front side than is the outer peripheral bottom 66 and adapted to abut against the upper face of the precision substrate storage container 3.

Thus constructed upper damping body 2C can also improve the vertical impact absorbing capability as with the above-mentioned damping bodies 2A, 2B. Specifically, in the event of an impact from the outside, the projections 64 and stepped part 67 can mitigate the impact while receiving it stepwise. This can inhibit the projections 64 and stepped part 67 from collapsing at once in the event of an impact, and prevent strong impacts from being exerted on the precision substrate storage container 3. This can further restrain the lid 32, to which the retainer 31 holding the precision substrate is attached, from fluctuating at once, whereby particles can be reduced.

Figure 18:
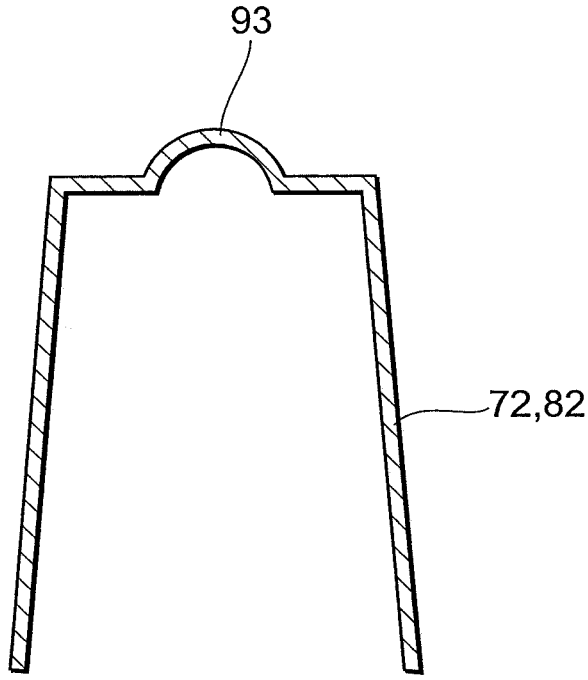
FIG. 18 is a sectional view of an outer peripheral wall formed with a reinforcement protrusion in accordance with a modified example of the present invention.

Though the reinforcement recesses 73, 83 depressed to the inside (depicted lower side) of the outer peripheral walls 72, 82 are formed in the damping bodies 2D, 2E in accordance with the above-mentioned second and third embodiments, the reinforcement recesses are not limited thereto. For example, as illustrated in FIG. 18, the reinforcement may be a reinforcement protrusion 93 projecting to the outside (depicted upper side) of the outer peripheral walls 72, 82.

Though the damping bodies 2A to 2E comprise the stepped parts 27, 47, 67, 77 in the above-mentioned embodiments, they may be damping bodies without stepped parts.

INDUSTRIAL APPLICABILITY

The present invention can be utilized in a damping body for packaging used when packaging precision substrate storage containers for storing precision substrates such as various wafers made of silicon, glass, compounds, oxides, and the like used for producing semiconductor devices such as transistors and diodes, semiconductor circuit parts such as memories and LSI, and optical circuit parts such as CCD and semiconductor lasers; semiconductor wafers; mask glass; pellicles; liquid-crystal glass; or information storage media such as hard disk substrates and optical disks made of aluminum, glass, and the like; and a package body equipped with this damping body.

The invention claimed is:

1. A damping body for packaging arranged on at least one of upper and lower sides of a precision substrate storage container when packaging the precision substrate storage container storing a precision substrate with a package body, the damping body comprising:

a bottom part covering an upper or lower face of the precision substrate storage container upon packaging;

an outer peripheral wall rising from an outer peripheral edge of the bottom part; and reinforcement formed with the outer peripheral wall;

wherein the bottom part has an abutment adapted to abut against the upper or lower face of the precision substrate storage container and an outer peripheral bottom formed on an outer periphery of the abutment at a position distance more from the precision substrate storage container than is the abutment;

wherein a stepped part is formed between the abutment and the outer peripheral bottom;

wherein the stepped part is constituted by a plurality of steps;

wherein the abutment is formed with a plurality of projections that project in the same direction as the outer peripheral wall rises; and a clearance is provided between a lower face of a leading end part of the projections and a lower end of the outer peripheral wall.

2. A damping body for packaging according to claim 1, wherein the reinforcement is a bellows.

3. A damping body for packaging according to claim 1, wherein the reinforcement is a recess or protrusion having an arc-shaped cross section.

4. A damping body for packaging according to claim 1, wherein the abutment is a pedestal projecting more to the precision substrate storage container than is the outer peripheral bottom.

5. A damping body for packaging according to claim 4, wherein the pedestal is formed with a projection projecting away from the precision substrate storage container and reducing a diameter stepwise as the projection separates from the precision substrate storage container.

6. A damping body for packaging according to claim 1, wherein the stepped part is formed with an inwardly depressed arc-shaped recess or outwardly projecting arc-shaped protrusion in a plan view.

7. A package body comprising the damping body for packaging according to claim 1.

8. A damping body for packaging arranged on at least one of upper and lower sides of a precision substrate storage container when packaging the precision substrate storage container storing a precision substrate with a package body, the damping body comprising:

a bottom part covering an upper or lower face of the precision substrate storage container upon packaging;

an outer peripheral wall rising from an outer peripheral edge of the bottom part; and reinforcement formed with the outer peripheral wall;

wherein the bottom part has an abutment adapted to abut against the upper or lower face of the precision substrate storage container and an outer peripheral bottom formed on an outer periphery of the abutment at a position distance more from the precision substrate storage container than is the abutment;

wherein a stepped part is formed between the abutment and the outer peripheral bottom;

wherein the bottom part has an opposing portion opposing the upper or lower face of the precision substrate storage container and a projection projecting to the precision substrate storage container than is the opposing portion and reducing a diameter stepwise as the projection separates from the precision substrate storage container; and wherein the abutment is formed by the projection.

* * * * *